US005524873A

United States Patent [19]

Hosoi et al.

[11] Patent Number: 5,524,873

[45] Date of Patent: Jun. 11, 1996

[54] FINISHER FOR IMAGE FORMING APPARATUS

[75] Inventors: Masatoshi Hosoi; Tetsuji Watanbe; Yuichi Fujii; Yuji Ueno; Nobuyoshi Seki; Mitsuru Ichikawa, all of Nagoya, Japan

[73] Assignee: Ricoh Elemex Corporation, Nagoya, Japan

[21] Appl. No.: 481,141

[22] Filed: Jun. 7, 1995

Related U.S. Application Data

[63] Continuation of Ser. No. 186,548, Jan. 26, 1994, abandoned.

[30] Foreign Application Priority Data

Jan. 29, 1993 [JP] Japan ..... 5-014227

[51] Int. Cl.[6] ..... B42B 2/00; B65H 39/11

[52] U.S. Cl. ..... 270/58.08; 270/58.16; 270/58.15; 271/293; 271/294; 271/221

[58] Field of Search ..... 271/292, 293, 271/294, 221, 222; 270/58, 53

[56] References Cited

U.S. PATENT DOCUMENTS

| | | | |
|---|---|---|---|
| 3,788,640 | 6/1974 | Stemmle | 271/293 |
| 5,035,412 | 7/1991 | Hiroi et al. | 271/292 |
| 5,090,673 | 2/1992 | Kitahara et al. | 271/221 |
| 5,236,185 | 8/1993 | Taneda et al. | 270/58 |
| 5,236,189 | 8/1993 | Ikoma | 271/292 |
| 5,305,994 | 4/1994 | Matsui et al. | 271/294 |
| 5,382,106 | 1/1995 | Kobayashi et al. | 271/221 |
| 5,384,634 | 1/1995 | Takehara et al. | 270/53 |

FOREIGN PATENT DOCUMENTS

| | | | |
|---|---|---|---|
| 4-257493 | 9/1992 | Japan | 270/53 |

*Primary Examiner*—H. Grant Skaggs
*Attorney, Agent, or Firm*—Oblon, Spivak, McClelland, Maier & Neustadt

[57] ABSTRACT

A finisher for finishing sheets for use in a copier, printer or similar image forming apparatus having a sorter for sorting sheets on a plurality of bins, and further having a stapler or a punching device. A bin moving member is provided for moving the plurality of bins to predetermined positions in which the bin moving member moves the bins to a positioning relationship such that an interval A between a first bin for accepting the discharged sheets from a discharging member and a third bin located at a position immediately over the first bin, an interval B between the first bin and a second bin located at a position immediately under the first bin, and an interval D between the third bin located at a position immediately over the first bin and a fifth bin located at a position immediately over the third bin are broader than an interval E between other adjacent regular bins.

6 Claims, 5 Drawing Sheets

FINISHER FOR IMAGE FORMING APPARATUS

This application is a continuation of application Ser. No. 08/186,548, filed on Jan. 26, 1994, now abandoned.

BACKGROUND OF THE INVENTION

1. Field of the Invention

The present invention relates to a finisher for finishing sheets for use in a copier, printer or similar image forming apparatus and, more particularly, to a finisher having a sorter for sorting sheets for a plurality of bins, and further having a stapler or a punch device.

2. Description of the Prior Art

Recently, various finishers which use helical cam shifts and have a plurality of bins moveable in the vertical direction have been proposed.

In the above-mentioned finisher, the space between a bin and an adjacent bin is relatively narrow in a waiting condition of an image forming apparatus, and the space between the first bin moved to the position at which image formed sheets are discharged and the second bin located at the position just above the first bin (such finisher being described in Japanese patent application Laid Open No. 64-64973/1989) is relatively broad in a sheet discharging condition.

A sufficient space between the top sheet in the bin for discharging sheets and the bin located at a position above the top sheet is necessary for accurately positioning the discharged sheets in the bins. If not enough space is provided, it is difficult to attain accurate positioning of the discharged sheets in the bin for discharging sheets. Because the curled sheet relatively forcefully touches the top sheet or the bin located at the position above the top sheet, it makes it difficult for sheet discharge into the preferred position of the bin. Furthermore, movement of the discharged sheet on the top sheet by a jogger is relatively difficult from the discharged position to a predetermined position.

On the other hand, in a sorter having the moveable bins, it is necessary that the next bin be moved to the sheet discharging position by completion of the period during which the next sheet may be discharged after the finished sheet is discharged into the bin.

FIG. 1 is a timing chart concerning bin movement and jogger movement of a prior art apparatus. In the figure, the jogger is the device for aligning sheet sides in the bin "$T_1$" (sec) shows the sheet discharging cycle, in which the sheet discharging is detected by a sensor, and "t" shows the period during which the discharging sheet drops into the bin and the sheet is moved to the end edge portion of the bin. The bin which is located at the discharging position has a space with a dimension of "45" mm in the upward direction of the bin and then the bin is moved up to the not-discharged position, wherein the space is "15" mm which is the regular spacing. The corresponding CPM (copying per minute) of the image forming apparatus is 60/T.

In order to attain high-speeding operations of the finisher, it is possible to perform the following steps.

(1) decrease the moving time of the bins (2) decrease the operation time of the jogger (3) speed up sheet discharging to the bin However, each step has the following shortcomings: As for item (1), it is necessary to employ an expensive motor. As for item (2), it is difficult to perfectly align the sides of the discharged sheet and as for item (3), the sheets are incorrectly stacked so that the sheets are aligned in a disorderly manner.

Furthermore, in order to attain high-efficiency operations of the finisher, it is possible that the finisher causes the jogger to align the sheets and thereby the bin moves at the same time.

However, if the bin space located over or under the bin, into which sheets are discharged, is established so as to be the same as the space formed by each of the other bins, the space which is formed by each of bins changes so as to be narrower corresponding to the bin's movement (for example, the space changes from 45 mm to 15 mm). This narrow space causes the side of the stacked sheets to be aligned in a disorderly manner, because the discharged sheets abut against the bins.

SUMMARY OF THE INVENTION

It is, therefore, an object of the present invention to provide an improved finisher for an image forming apparatus, in which the above-mentioned conventional apparatus shortcomings are eliminated. More specifically, it is an object of the present invention to provide a finisher for an image forming apparatus which is capable of causing the jogger to operate for aligning the side of the sheets and movement of the bin at the same time, and attain high-efficiency operations for arranging sheets Other objects, advantages and novel features of the present invention will become apparent from the following detailed description of the invention when considered in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
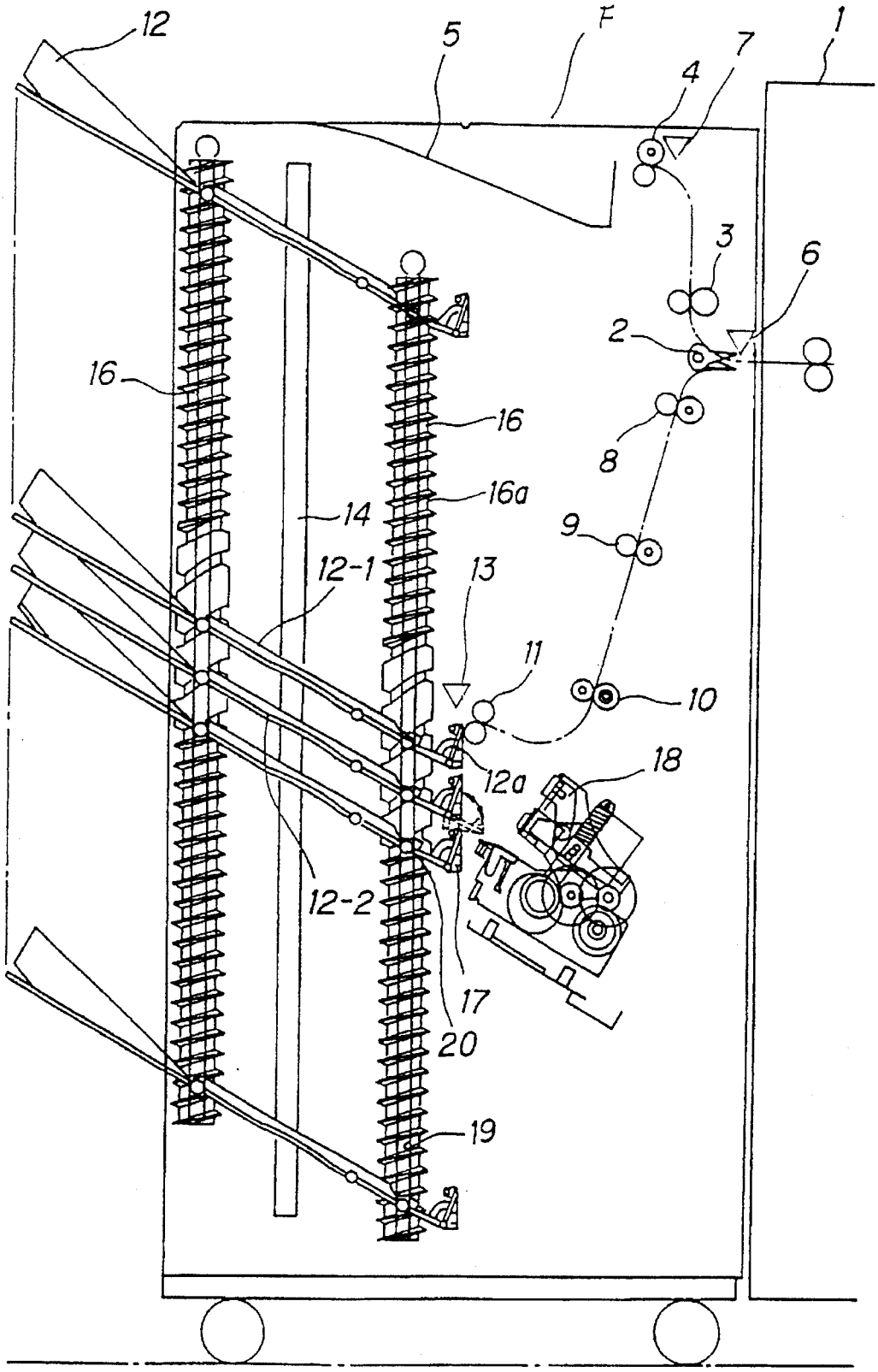
FIG. 2 is a front view showing an embodiment of a finisher according to the present invention.

As shown in FIG. 2, a discharging sheet from a main body 1 of an image forming apparatus of a preferred embodiment of the present invention is divided into a proof tray section and a bins section by a guide pawl 2.

To begin with, a mechanism for feeding sheets to a proof tray 5 and its operation are explained. An operating portion (not shown) of a copier of the present invention is started and run by a starting signal and a signal for deciding the sheet discharging position from the main body 1, and the guide pawl 2 is moved downward. The discharged sheet from the main body 1 is guided by the guide pawl 2, fed by a pair of feeding rollers 3 and a pair of discharging rollers 4, and is discharged into the proof tray 5. Problems such as jamming of sheets are detected by a sensor 6 located at the entrance of the finisher F and by a sensor 7 located at the entrance of the proof tray 5.

Next, a mechanism for feeding sheets to the bins sections and sorting operation thereof is explained. The operating portion (not shown) is started and run by the starting signal and the signal for deciding the sheet discharging position from the main body 1, and the guide pawl 2 is moved upwardly. The discharged sheet from the main body 1 is guided therein by the guide pawl 2 and fed by three pairs of feeding rollers 8, 9 10 functioning as a sheet feeding member. Thereafter, the discharging sheet is discharged into a first bin 12-1 for accepting the discharged sheet by a pair of rollers 11. A plurality of the bins 12 are arranged in a vertical direction.

The linear velocity for discharging a sheet from the rollers 11 is reduced and the sheet is discharged to the first bin 12-1. In this embodiment, the first linear velocity is 1000 mm/sec, and this is reduced to 600 mm/sec at a position 30 mm before the first bin 12-1.

Figure 3:
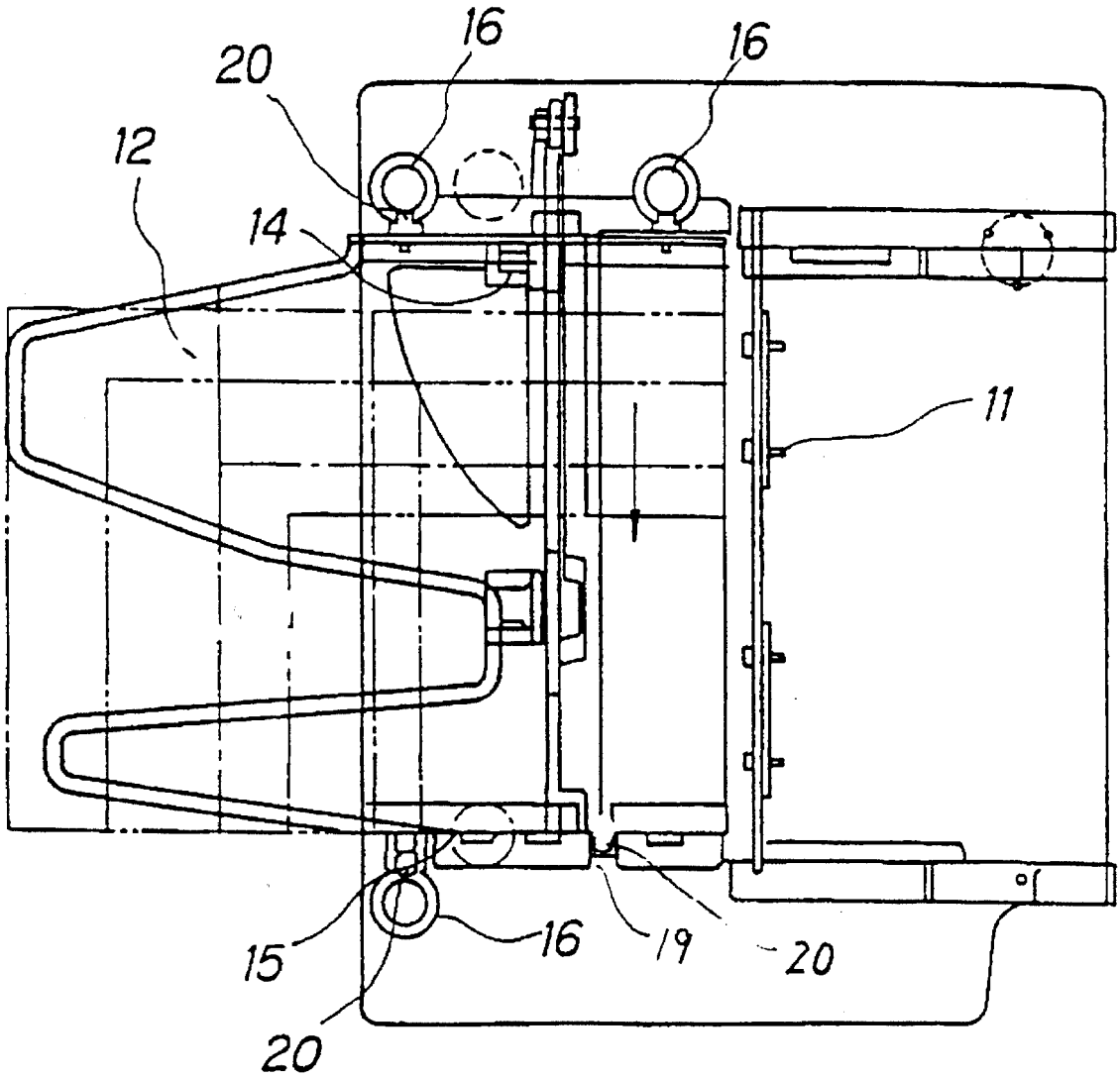
FIG. 3 is a plan view showing an embodiment of the finisher according to the present invention.

The completion of sheet discharging is detected by a sensor 13 for detecting sheet discharging into the first bin 12-1. After completion of sheet discharging, the discharged sheet falls down into the end portion 12*a* of the bin. Furthermore, after about 300 msec elapses from the completion of sheet discharging, a jogger shaft 14 as an aligning member moves in the drawing-up direction as shown in FIG. 3 and touches the side portion of the sheets in bins 12. The sheets in the bins 12 are moved to each of a plurality of standard fences 15, wherein the standard fences 15 are also used as a side fence of the bins 12 for aligning the side of the sheets. Herein, the jogger device comprises the jogger shaft 14, a shift motor, a timing belt, a pulley, etc.

At the same time as the sheet-aligning operation by the jogger shaft 14 occurs, each of three helical cam shafts 16 acting as a bin moving member rotates by one rotation and moves the plurality of bins up or down. The helical cam shafts 16 have spiral cam grooves which are provided with an equal pitch and spiral cam grooves which have an unequal pitch.

Each of guide pins 20, which is provided at each of the sides of the bin, is guided by each of the spiral cam grooves of the helical cam shafts 16. A guide slit 19 provided on a side wall of the finisher F also guides the guide pins 20 in the vertical direction. The helical cam shaft 16 is rotationally driven by a stepping motor (not shown). Each of helical shafts 16 rotates in the regular forward direction or in a reverse direction, and the bins 12 move upward or downward. It takes 400 msec for the plurality of the bins 12 to move from a particular bin's position to the next bin's position corresponding to one rotation of the helical cam shafts 16. The above-mentioned series of operations are repeated to sort and align the side of the sheets.

Problems such as jamming of the sheets are detected by the sensor 6 located at the entrance of the finisher F and the sensor 13 for detecting sheet discharging into the first bin 12-1. After completing sorting operation of the discharged sheets, a bin end fence 17 is released and the respective stacked sheets in the bin 12, which is located at the position of a second bin 12-2 shown in FIG. 2, are moved by a chuck unit (not shown) moving toward a stapler 18. The stacked sheets are stapled by the stapler 18. The chuck unit is moved in the reverse direction and the stacked and stapled sheets are returned from the stapler position into the bin 12-2. The bin end fence 17 is closed and then the plurality of bins 12 are moved upward or downward. The above-mentioned series of operations for stapling sheets is repeated for stapling sheets from the beginning.

In FIG. 2, the first bin 12-1, into which the sheet is discharged, is located at a position facing toward the rollers 11 and the second bin 12-2, which is the bin for performing subsequent processing such as stapling, is located at a position just under the first bin 12-1 and faces toward the stapler. A sufficient interval between the first bin 12-1 and the second bin 12-2 is established for moving the chuck unit, as will be described later in detail.

Figure 4:
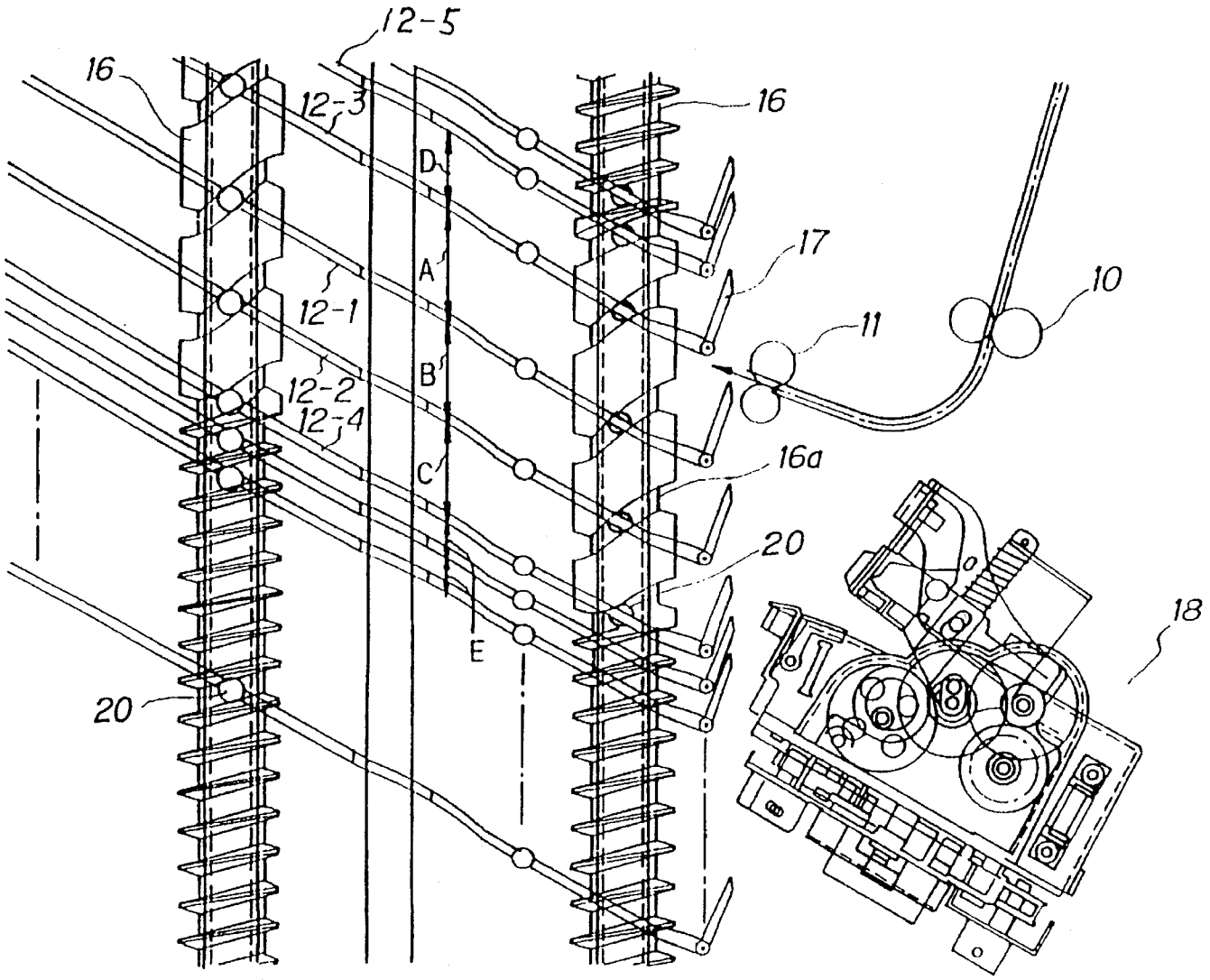
FIG. 4 is an enlarged front view of bin portion showing an embodiment of the finisher according to the present invention.

In this embodiment, twenty bins are utilized and the plurality of bins 12 comprise the first bin 12-1, the second bin 12-2, a third bin 12-3, a fourth bin 12-4, a fifth bin 12-5 and other regular bins. As shown in FIG. 4, each of the intervals "E" between the other regular bins is 15 mm, an interval "A" between the first bin 12-1 and third bin 12-3 located at a position just over the first bin 12-1 is 45 mm, an interval "B" between the first bin 12-1 and the second bin 12-2 located at a position just under the first bin 12-1 is 40 mm, an interval "C" between the second bin 12-2 and the fourth bin 12-4 located at a position just under the second bin 12-2 is 40 mm and an interval "D" between the third bin 12-3 and fifth bin 12-5 located at a position immediately above the third bin 12-3 is 30 mm. The above-mentioned intervals are established by each of the spiral cam grooves of the helical cam shafts 16 in accordance with the relationship of the following inequality: $A \geqq B \geqq C \geqq D \geqq E$ such that at least the first, second, third bins are directly adjacent to one another and have greater intervals therebetween than the interval E between the other regular bins, as is shown in FIG. 4.

The spiral cam grooves 16*a* are formed in the helical cam shafts 16 so as to position each of bins with the above-mentioned relationship.

Therefore, when each of helical shafts 16 rotates in the regular direction and the bins 12 move upward, the respective bins 12 move from the respective particular bin's position to the next upper bin's position corresponding to one rotation of the helical cam shaft 16 and the newly positioned bins keep the above-mentioned relationship of intervals by the helical cam shafts 16.

The intervals "A", "B" and "C" are kept relatively broad during the period of the bin's moving. Therefore, when the jogger operates to align the sheets, there are sufficient intervals for the respective adjacent bins to prevent the sheets from abutting the lower surface of the bin located at the upper position of the sheet.

Furthermore, sufficient intervals "B" and "C" are necessary for moving the chuck unit toward the stapler 18. Therefore, the interval "B" and "C" are broader than the intervals of the regular bins.

Figure 5:
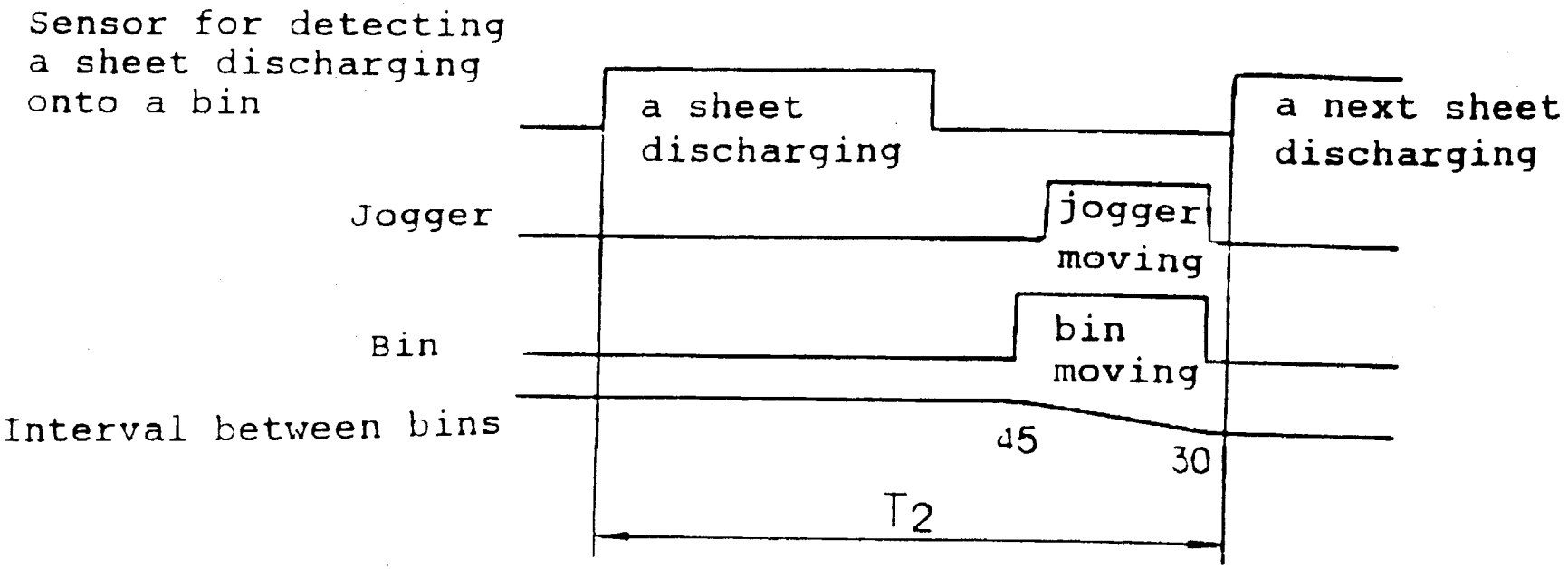
FIG. 5 is a timing chart concerning bin movement and jogger movement of an embodiment of the finisher according to the present invention.

FIG. 5 is a timing chart showing bin movement and jogger movement concerning the embodiment of the finisher according to the present invention.

Figure 1:
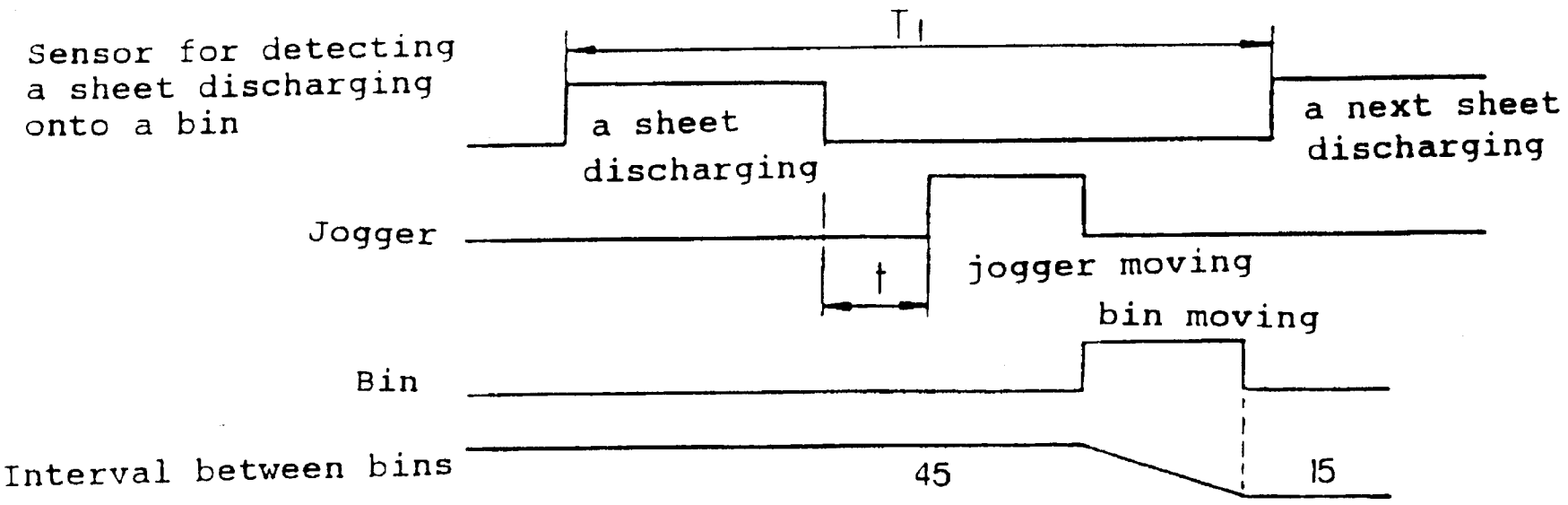
FIG. 1 PRIOR ART
FIG. 1 is a timing chart concerning bin movement and jogger movement of a prior art apparatus.

In comparison with FIG. 1, the sheet discharging period "$T_2$" in FIG. 5 is shorter than the operation time of the bin lifting movement. This is because the finisher F causes the jogger to operate for aligning sheets and the finisher F causes the bin to move at the almost same time.

Assuming that the sheet size is A4 (its width being 210 mm), the discharging velocity is 600 mm/sec, the waiting time for starting the jogger operation is 300 msec, the jogger operation time is 250 msec, and the bin movement time is 450 msec.

In the prior art, $$T_1=(210/600)\times1000+300+250+450=1350\ (msec)$$

Therefore, the corresponding CPM of the image forming apparatus equals 44.4 ($60/T_1=60/1.35$).

In the present invention, however, $$T_2=(210/600)\times1000+300+250=900\ (msec.)$$

Therefore, corresponding CPM (copying per minute) of the image forming apparatus equals 66.7 ($60/T_2=60/0.9$), and the copying efficiency is thus increased by approx. 50%.

In above-mentioned embodiment, the sheet-discharging can be performed smoothly and the loading capacity can be increased, because the space above the first bin 12-1, the space above the third bin 12-3 located at the upper position of the first bin 12-1 and the space above the second bin 12-2 located at the lower position of the first bin 12-1 can be made relatively broad.

The interval between the respective adjacent bins can be kept relatively broad during the period of the bin's moving. Therefore, when the jogger operates to align the side of the sheets, there is a sufficient interval between the respective adjacent bins to prevent the sheet from abutting on the lower surface of the bin located at the upper position of the sheet.

It is possible that the finisher causes the jogger to operate for aligning the side of sheets and moves the bins at the same time without causing stacked sheets to be aligned in a disorderly manner. As a result, the embodiment attains a high-CPM.

On the other hand, the intervals between the adjacent regular bins are established so as to be a minimum, and therefore a compact-size finisher can be provided.

Furthermore, in the above-mentioned embodiment, if the sheet has a curled portion, the discharged sheets are aligned without suffering from the influence by the lower surface of the above bins. This is because the intervals A, B and D are made over two times as broad as the interval between the adjacent regular bins.

Hereinbelow, the basis of the above-noted phrase "over two times" is described briefly. In the case of stacking the fifth sheets, the thickness of the sheet is about 13 mm. Namely, an "about 13 mm" interval between the bins is necessary for stacking the sheets in the bin. However, considering that curled sheets exists and the sheets are jogged to be aligned, a "more than about 10 mm" interval is necessary to add to the above interval of "13 mm". The necessary interval adds up to over "23 mm". Therefore, it is necessary that the intervals A, B and D be over two times as broad as the interval between the regular bins.

Obviously, numerous modifications and variations of the present invention are possible in the light of the above teachings. It is therefore to be understood that, within the scope of the appended claims, the invention may be practiced otherwise than as specifically described herein.

What is claimed is:

1. A sorter for sorting sheets for use in an image forming apparatus, which comprises:

a sheet feeding mechanism feeding sheets from said image forming apparatus;

a plurality of bins accepting said sheets fed from said sheet feeding mechanism, said bins being arranged in a vertical direction;

a discharging mechanism discharging said sheets so as to be accepted into said bins;

an aligning mechanism aligning a side of said sheets in the bins, wherein said aligning mechanism is arranged laterally of said bins;

a bin moving mechanism moving said bins to predetermined positions in an upward or downward direction so as to sort said sheets, said bin moving mechanism having a mechanism varying spacing between the bins so as to increase spacing between a group of at least five bins which are directly adjacent one another such that the efficiency of stacking of said sheets in said bins and of aligning of said sheets in said bins is increased, wherein said bin moving mechanism moves said bins to establish positional relationships therebetween, wherein interval A comprises an interval between a first bin of said five bins for accepting said discharged sheets from said discharging mechanism and a third bin of said five bins located at a position immediately over said first bin, interval B comprises an interval between said first bin and a second bin of said five bins located at a position immediately under said first bin, interval D comprises an interval between said third bin located at a position immediately over said first bin and a fifth bin of said five bins located at a position immediately over said third bin and wherein said intervals A, B and D are broader than an interval E between other adjacent regular bins; and said aligning mechanism and said bin moving mechanism operate at the same time, wherein said interval A is broader than said interval E while said first and third bins which form the interval A are moved by said bin moving mechanism to predetermined positions in the upward or downward direction so as to sort said sheets.

2. A sorter-as claimed in claim 1, which comprises:

a stapling mechanism stapling a stack of sheets accepted into said second bin, said stapling mechanism being located in proximity with intervals B and C.

3. A finisher as claimed in claim 2, wherein each of intervals A, B and D is over two times as broad as interval E.

4. A sorted as claimed in claim 1, wherein said bin moving mechanism moves said plurality of bins to establish intervals between said plurality of bins in accordance with the relationship of the following inequality:

A is $\geqq B \geqq C \geqq D \geqq E$;

and including a stapling mechanism stapling a stack of sheets accepted into said second bin, said stapling mechanism being located in proximity with intervals B and C.

5. A finisher as claimed in claim 4, wherein each of intervals A, B and D is over two times as broad as interval E.

6. A finisher as claimed in claim 1, wherein each of intervals A, B and D is over two times as broad as interval E.

* * * * *

UNITED STATES PATENT AND TRADEMARK OFFICE

CERTIFICATE OF CORRECTION

PATENT NO. : 5,524,873

DATED : June 11, 1996

INVENTOR(S) : Masatoshi HOSOI, et al.

It is certified that error appears in the above-indentified patent and that said Letters Patent is hereby corrected as shown below:

On the title page, in Item [75], the second inventor's name should read:

--Tetsuji WATANABE--

Signed and Sealed this

Nineteenth Day of November, 1996

*Attest:*

*Attesting Officer*

BRUCE LEHMAN

*Commissioner of Patents and Trademarks*